US007195052B2

(12) United States Patent
Nien et al.

(10) Patent No.: US 7,195,052 B2
(45) Date of Patent: Mar. 27, 2007

(54) CORD-DRIVEN ROTATOR FOR DRIVING ROLLER OF WINDOW BLIND

(75) Inventors: Ming Nien, Changhua Hsien (TW); Yuche Wen, Gueishan Township, Taoyuan County (TW); Chih-Yao Chang, Taichung (TW)

(73) Assignee: Nien Made Enterprise Co., Ltd., Taichung (TW)

( * ) Notice: Subject to any disclaimer, the term of this patent is extended or adjusted under 35 U.S.C. 154(b) by 259 days.

(21) Appl. No.: 10/901,232

(22) Filed: Jul. 29, 2004

(65) Prior Publication Data

US 2005/0247413 A1 Nov. 10, 2005

(30) Foreign Application Priority Data

May 7, 2004 (TW) ..... 93207201 U

(51) Int. Cl.
*E06B 9/56* (2006.01)

(52) U.S. Cl. ..... 160/321; 160/319.193

(58) Field of Classification Search ..... 160/321, 160/319.193, 323.1; D6/58
See application file for complete search history.

(56) References Cited

U.S. PATENT DOCUMENTS 2,935,881 A * 5/1960 Cayton ..... 474/164
5,361,822 A * 11/1994 Nijs ..... 160/321
5,375,643 A * 12/1994 Rude ..... 160/321
5,507,374 A * 4/1996 Rude ..... 192/223.4
5,669,432 A * 9/1997 Nisenson et al. ..... 160/307
5,934,354 A * 8/1999 Price et al. ..... 160/370.22
6,116,325 A * 9/2000 Colson et al. ..... 160/321
6,164,428 A * 12/2000 Berman et al. ..... 192/223.4
6,173,825 B1 * 1/2001 Liu ..... 192/223.4
6,981,539 B2 * 1/2003 Fraczek ..... 160/84.05
6,685,592 B2 * 2/2004 Fraczek et al. ..... 475/14
6,843,302 B2 * 1/2005 Nijs ..... 160/321

* cited by examiner

*Primary Examiner*—Hugh B. Thompson, II
*Assistant Examiner*—Candace L. Bradford
(74) *Attorney, Agent, or Firm*—Birch, Stewart, Kolasch & Birch, LLP

(57) ABSTRACT

A rotator, which is driven by an endless cord member to rotate, is used in a window blind for driving a roller of the window blind. The rotator includes a base having a shaft, a first clamping plate and a second clamping plate rotatably serially mounted on the shaft of the base for clamping the cord member therebetween, and an elastic biasing device provided between the base and one of the first and second clamping plates for urging the first and second clamping plates against each other.

9 Claims, 7 Drawing Sheets

CORD-DRIVEN ROTATOR FOR DRIVING ROLLER OF WINDOW BLIND

This Non-provisional application claims priority under 35 U.S.C. § 119(a) on patent application Ser. No(s). 093207201 filed in Taiwan, Republic of China on May 7, 2004, the entire contents of which are hereby incorporated by reference.

BACKGROUND OF THE INVENTION

1. Field of the Invention

The present invention relates to generally to a rotator, which is connected with and driven by an endless cord member, for use in a window blind for driving a roller around which a blind shade is wound, and more particularly to such a cord-driven rotator, which has a cord member clamping function that prevents the cord member from slipping relative to the rotator.

2. Description of the Related Art

A conventional cord-driven rotator for use in a lifting window blind or the like is known comprising a base, which has a shaft, a friction wheel, which is pivoted to the shaft and has a V-shaped groove extended around the periphery, and an axle sleeve sleeved onto the shaft and connected between the friction wheel and the roller for synchronous rotation with the friction wheel on the shaft for driving the roller of the lifting window blind. The endless lift cord of the lifting window blind is hung in the V-shaped groove of the friction wheel and extended around the periphery of the upper half of the friction wheel. When pulling the lift cord, the friction wheel is driven by the lift cord to rotate the axle sleeve on the shaft, thereby causing the roller of the lifting window blind to rotate and to further lift or lower the blind shade that is connected to the roller. The V-shaped groove receives the lift cord, preventing slipping of the lift cord. In an alternative design of the conventional cord-driven rotator, the friction wheel is made having recessed round holes in two opposite sides thereof adjacent to the V-shaped groove for accommodating the beads of a lift cord formed of a chain of beads. However, because the pitch between each two adjacent recessed round holes is fixed, the friction wheel fits only one specific chain of beads. Therefore, different friction wheels shall be used to fit different sizes of chains of beads.

Further, after a long time of use of the cord-driven rotator, the V-shaped groove or the recessed round holes may become wear, thereby not enabling to hold the lift cord in place.

SUMMARY OF THE INVENTION

It is one objective of the present invention to provide a cord-driven rotator, which has a cord member clamping function that prevents the cord member from slipping relative to the rotator.

It is another objective of the present invention to provide a cord-driven rotator, which fits any of a variety of cord members of different thickness.

To achieve these objectives of the present invention, the cord-driven rotator, which is driven by an endless cord member to rotate and is used in a window blind for driving a roller of the window blind, comprises a base having a shaft, a first clamping plate and a second clamping plate rotatably serially mounted on the shaft of the base for clamping the cord member therebetween, and an elastic biasing device provided between the base and one of the first and second clamping plates for urging the first and second clamping plates against each other.

Further scope of the applicability of the present invention will become apparent from the detailed description given hereinafter. However, it should be understood that the detailed description and specific examples, while indicating preferred embodiments of the invention, are given by way of illustration only, since various changes and modifications within to spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
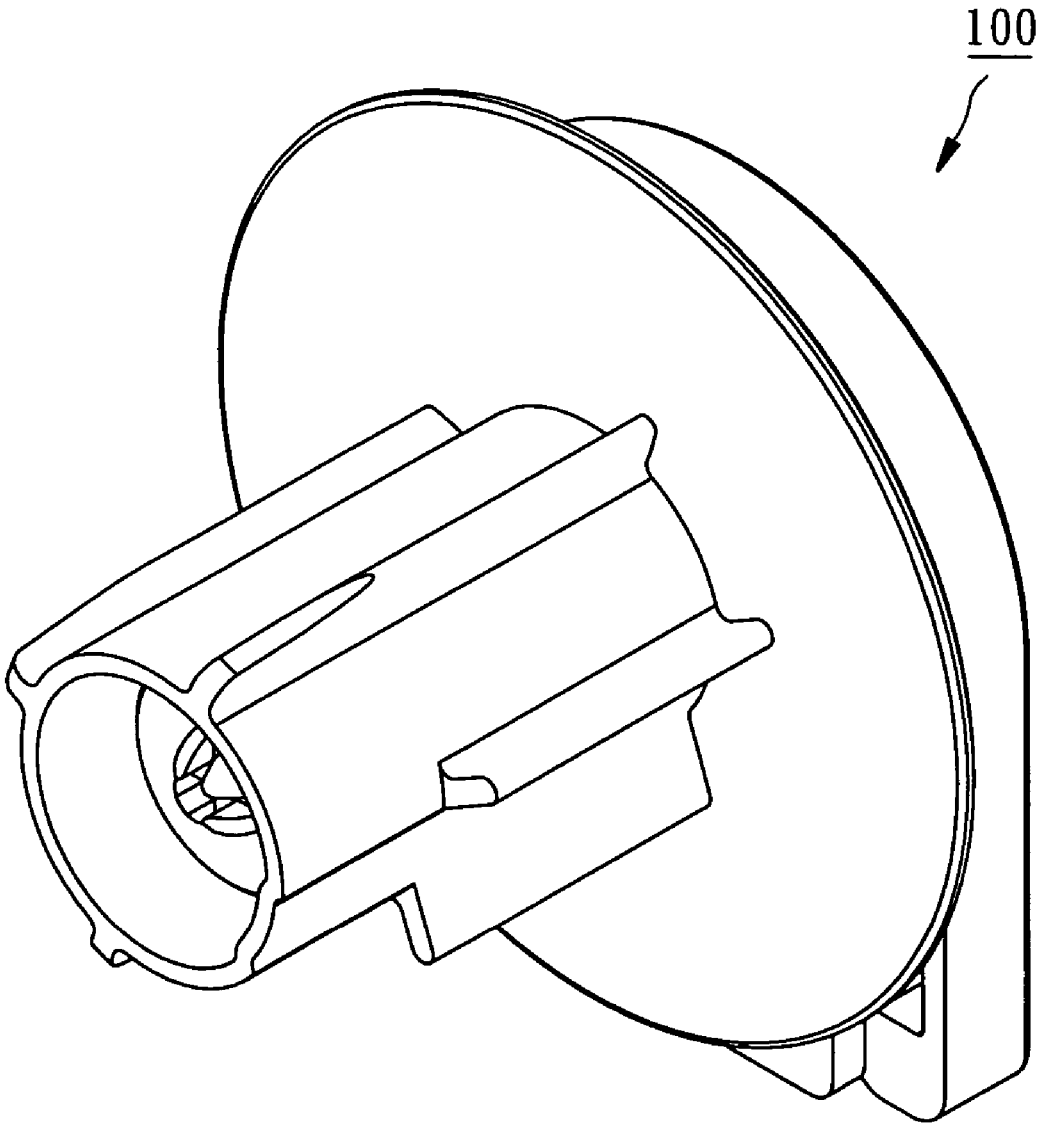
FIG. 1 is a perspective view of a cord-driven rotator according to a first preferred embodiment of the present invention.
Figure 2:
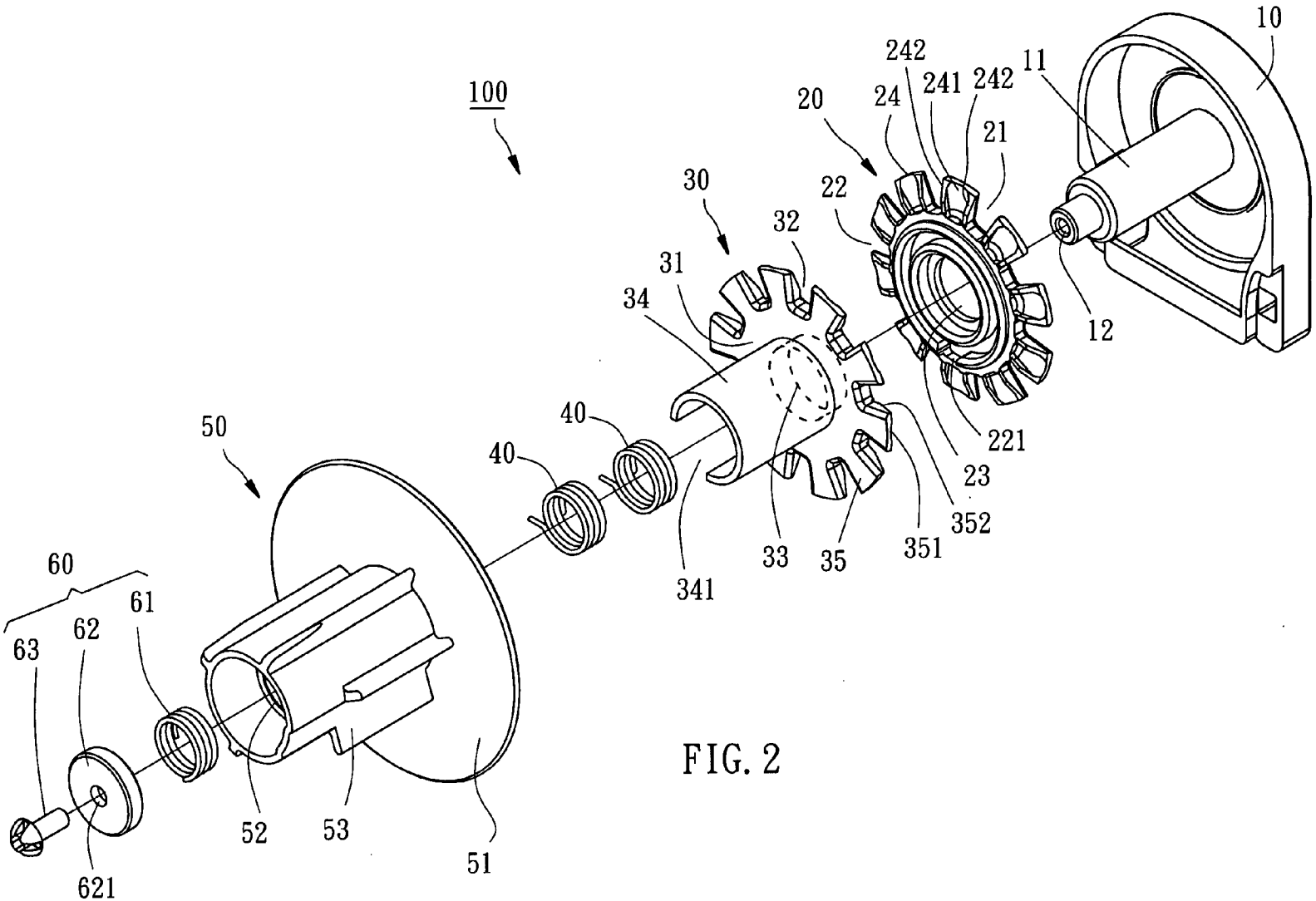
FIG. 2 is an exploded view of the cord-driven rotator according to the first preferred embodiment of the present invention.
Figure 3:
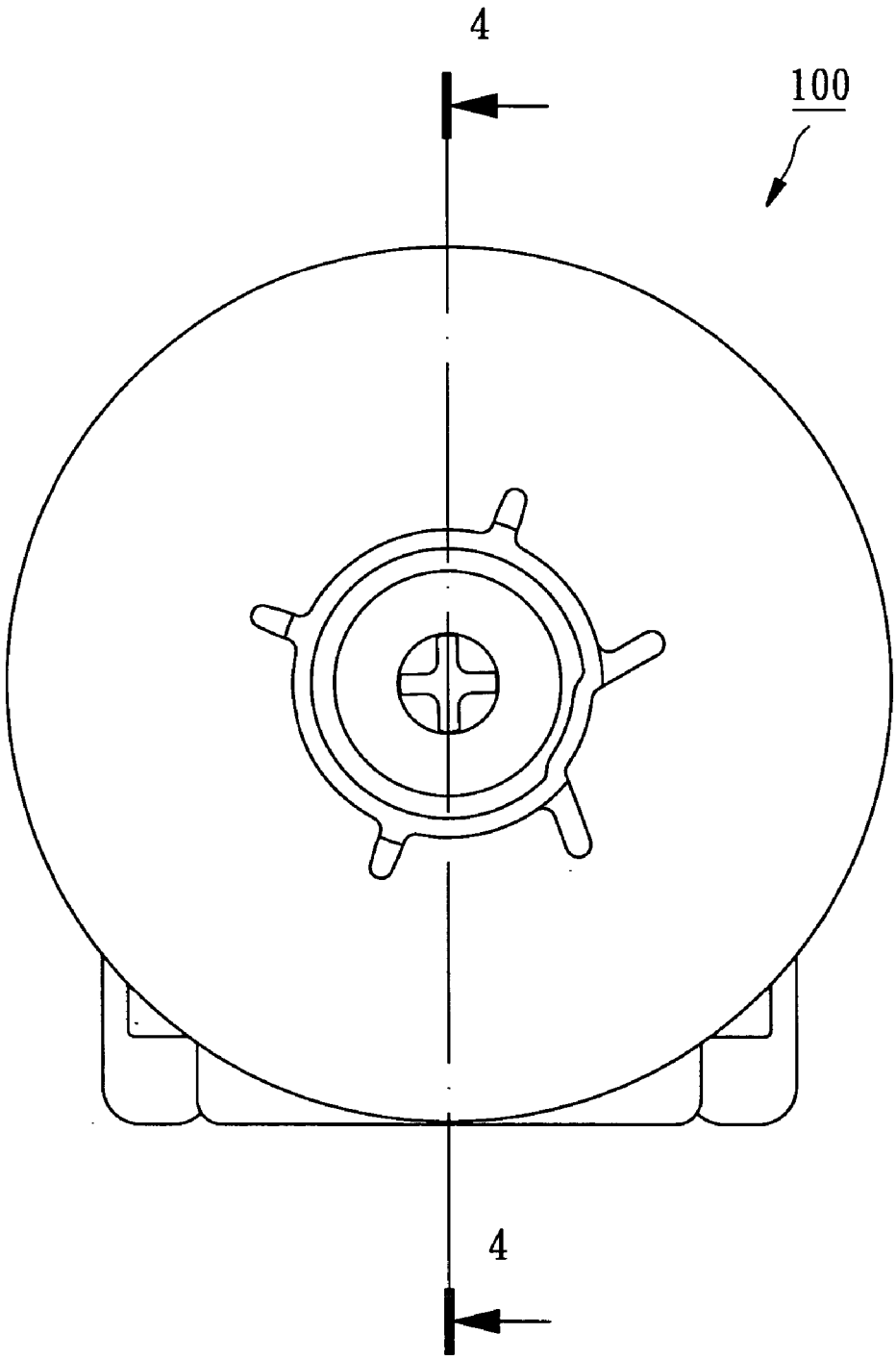
FIG. 3 is a front view of the cord-driven rotator according to the first preferred embodiment of the present invention.
Figure 4:
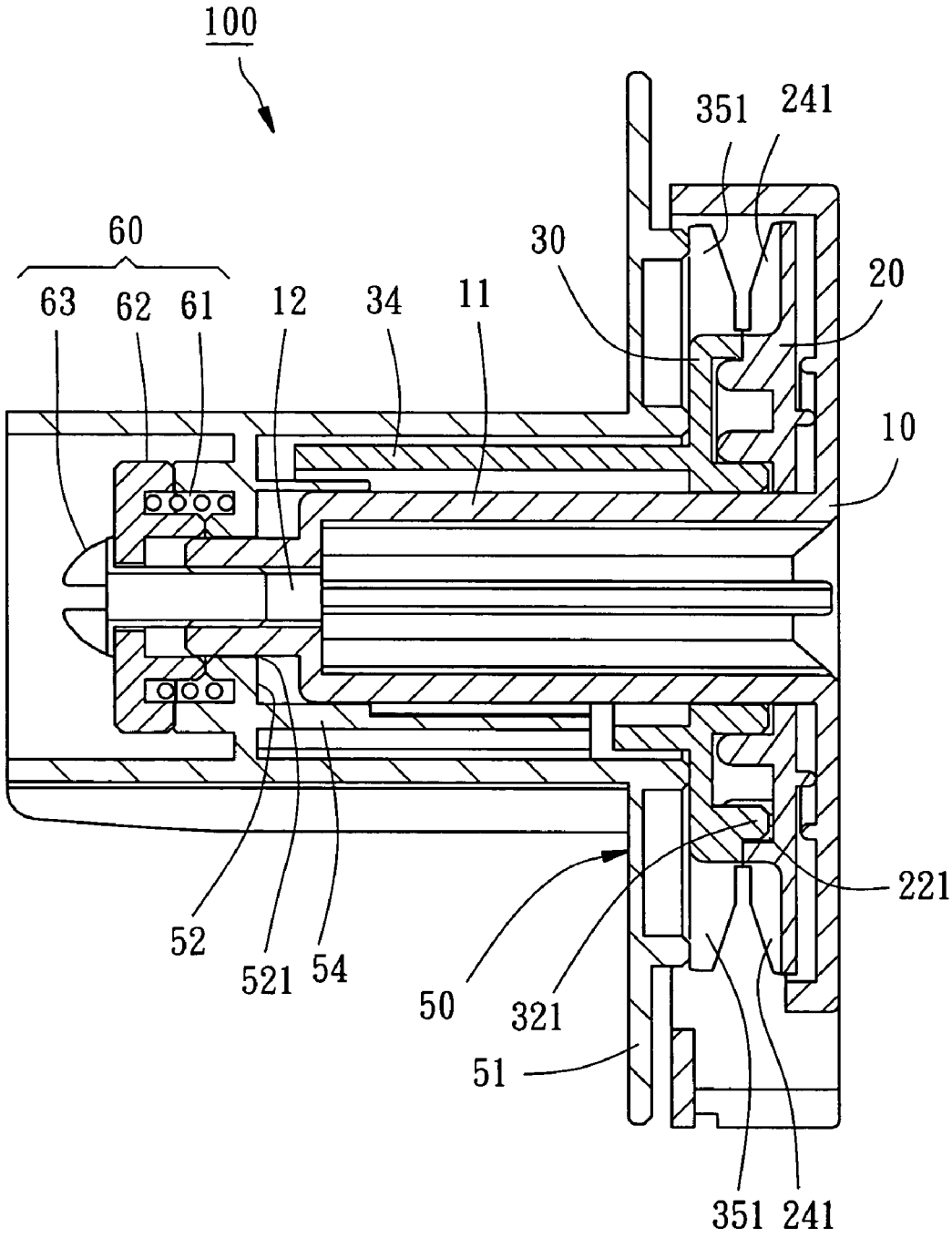
FIG. 4 is a sectional view taken along line 4—4 of FIG. 3.

Referring to FIGS. 1–4, a cord-driven rotator 100 according to the first preferred embodiment of the present invention is shown comprised of a base 10, a first clamping plate 20, a second clamping plate 30, two positioning members 40, a hub 50, and an elastic biasing device 60.

The base 10 comprises a shaft 11, which has a screw hole 12 axially extended in the distal end.

The first clamping plate 20 is shaped like a circular member having a stop face 21, a clamping face 22 opposite to the top face 21, a center axle hole 23 cut through the stop face 21 and the clamping face 22 at the center and coupled to the shaft 11 of the base 10 to let the stop face 21 be set in close contact with the inside wall of the base 10, a coupling groove 221 formed in the clamping face 22, and a plurality of fins 24 equiangularly spaced around the periphery. The fins 24 each have a radially extended groove 241 corresponding to the clamping face 22, and two sloping edges 242 radially extended along two sides of the groove 241. The height of the sloping edges 242 gradually reduces in direction from the inner side toward the outer side.

The second clamping plate 30 is shaped like a circular member having a stop face 31, a clamping face 32 opposite to the stop face 31, a center axle hole 33 cut through the stop face 31 and the clamping face 32 at the center and coupled to the shaft 11 of the base 10 to let the clamping face 32 face be set in contact with the clamping face 22 of the first clamping plate 20, an axle sleeve 34 perpendicularly extended from the stop face 31 around the border of the center axle hole 33 and sleeved onto the shaft 11 of the base 10, the axle sleeve 34 having a slot 341 axially extended to the front and bottom ends thereof, a coupling block 321 perpendicularly extended from the clamping face 32 and coupled to the coupling groove 221 of the first clamping plate 20 to let the second clamping plate 30 be synchronous rotatable with the first clamping plate 20 on the shaft 11 of the base 10, and a plurality of fins 35 equiangularly spaced around the periphery. The fins 35 each have a radially extended groove 351 corresponding to the clamping face 32, and two sloping edges 352 radially extended along two sides of the groove 351. The height of the sloping edges 352 gradually reduces in direction from the inner side toward the outer side. On design, the first clamping plate 20 and the second clamping plate 30 can be arranged to have the grooves 241 of the fins 24 of the first clamping plate 20 correspond to the grooves 351 of the fins 35 of the second clamping plate 30. Alternatively, the first clamping plate 20 and the second clamping plate 30 can be so designed to have the grooves 241 of the fins 24 of the first clamping plate 20 and the grooves 351 of the fins 35 of the second clamping plate 30 be arranged in a staggered manner.

The two positioning members 40 are two tensile springs mounted inside the axle sleeve 34 and adapted to stop the first clamping plate 20 and the second clamping plate 30 from rotation and to further stop the blind shade or slats of the window blind in position after release of an external driving force from the clamping plates 20, 30. Since the structural relationship of the positioning member 40 are of known art, no more detailed description concerning the positioning members is recited.

The hub 50 is a hollow member having a center through hole 521, which diameter is greater than the outer diameter of the axle sleeve 34 of the second clamping plate 30, a circular partition plate 51 radially extended around one end thereof, an inside annular flange 52 suspended in the center through hole 521, an inside rib 54 axially extended from the inside annular flange 52 toward the circular partition plate 51, and a plurality of radial flanges 53 equiangularly spaced around the periphery for engaging into the roller of a window blind (not shown). The hub 50 is sleeved onto the axle sleeve 34 of the second clamping plate 30 to engage the inside rib 54 into the slot 341 of the axle sleeve 34 of the second clamping plate 30 and to stop the circular partition plate 51 against the stop face 31 of the second clamping plate 30. By means of the engagement between the inside rib 54 of the hub 50 and the slot 341 of the axle sleeve 34, the hub 50 can be synchronously rotated with the second clamping plate 30 on the shaft 11 of the base 10.

The elastic biasing device 60 is comprised of a spring member 61, a washer 62, and a screw 63. The spring member 61 has one side stopped at the inside annular flange 52 of the hub 50. The washer 62 is stopped at the other side of the spring member 61, having a center through hole 621. The screw 63 is inserted through the center through hole 621 of the washer 62 and the spring member 61 and then threaded into the screw hole 12 of the shaft 11 of the base 10 to secure the washer 62 and the spring member 61 to the shaft 11, thereby causing the spring member 61 to urge the hub 60 on the second clamping plate 30 and to further force the second clamping plate 30 against the first clamping plate 20. Therefore, a clamping force is produced between the clamping face 22 of the first clamping plate 20 and the clamping face 32 of the second clamping plate 30 to retain the lift cord. Therefore, the invention effectively prevents slipping of the lift cord (insufficient friction force between the lift cord and the cord-driven rotator causes the lift cord to slip). When used with a lift chain of beads, the beads of the lift chain of beads be positioned in the between the matched grooves 241, 351 or in the grooves 241, 351 that are arranged in a staggered manner, preventing slipping of the lift chain of beads. In addition to the aforesaid cord member clamping effect, the pitch between the clamping face 22 of the first clamping plate 20 and the clamping face 32 of the second clamping plate 30 can be elastically adjusted to fit different thickness of lift cords or lift chains of beads.

Figure 5:
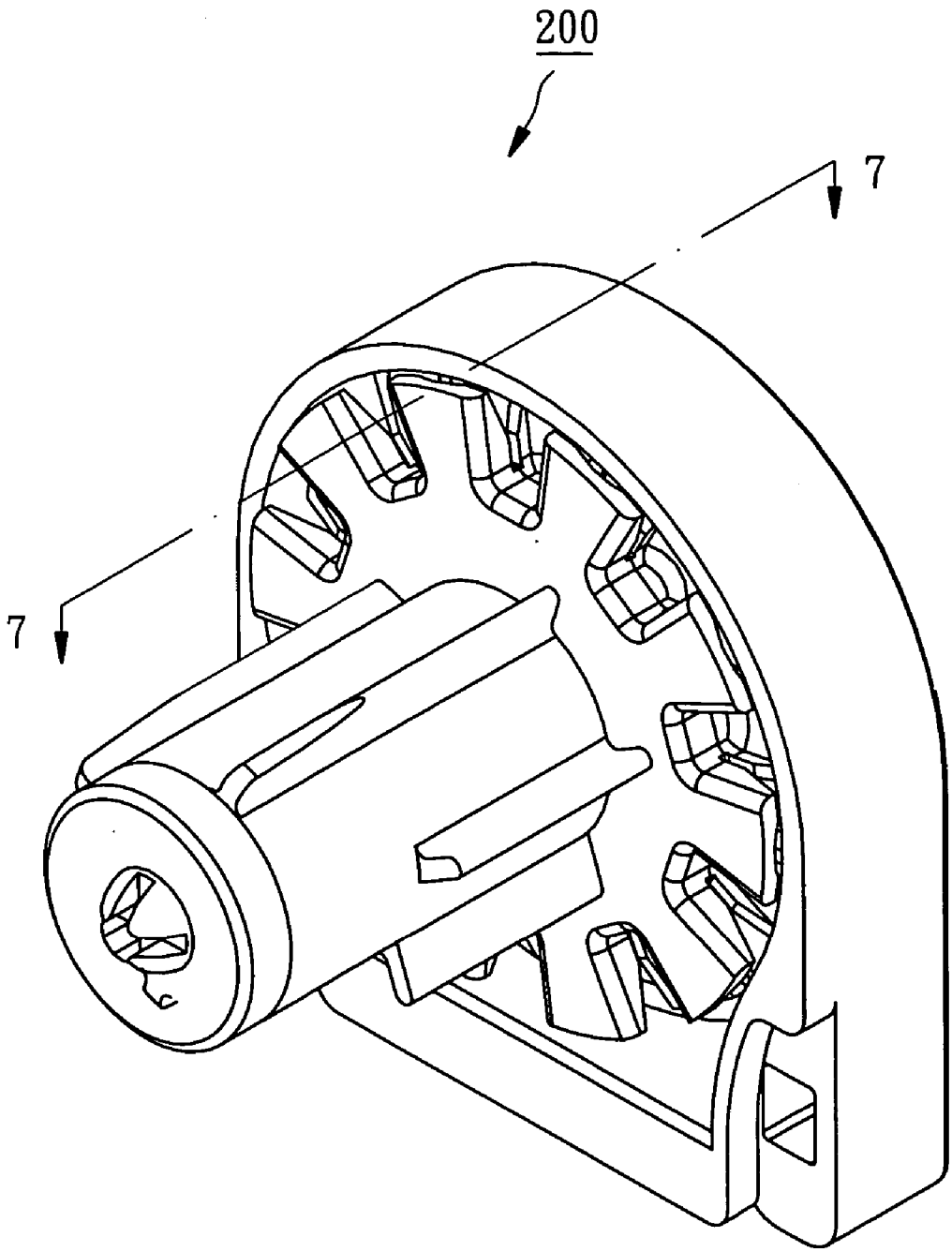
FIG. 5 is a perspective view of a cord-driven rotator according to a second preferred embodiment of the present invention.
Figure 6:
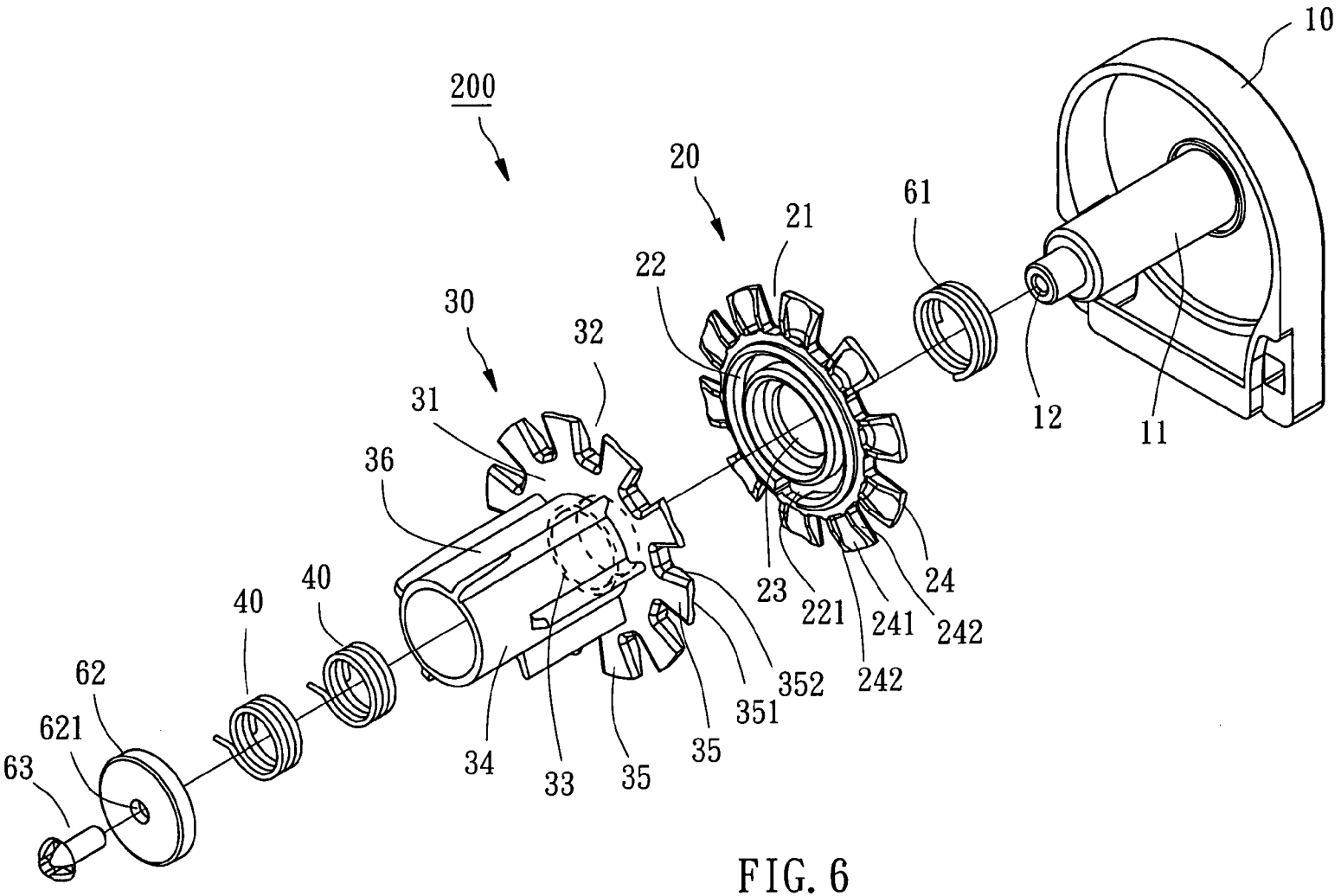
FIG. 6 is an exploded view of the cord-driven rotator according to the second preferred embodiment of the present invention.
Figure 7:
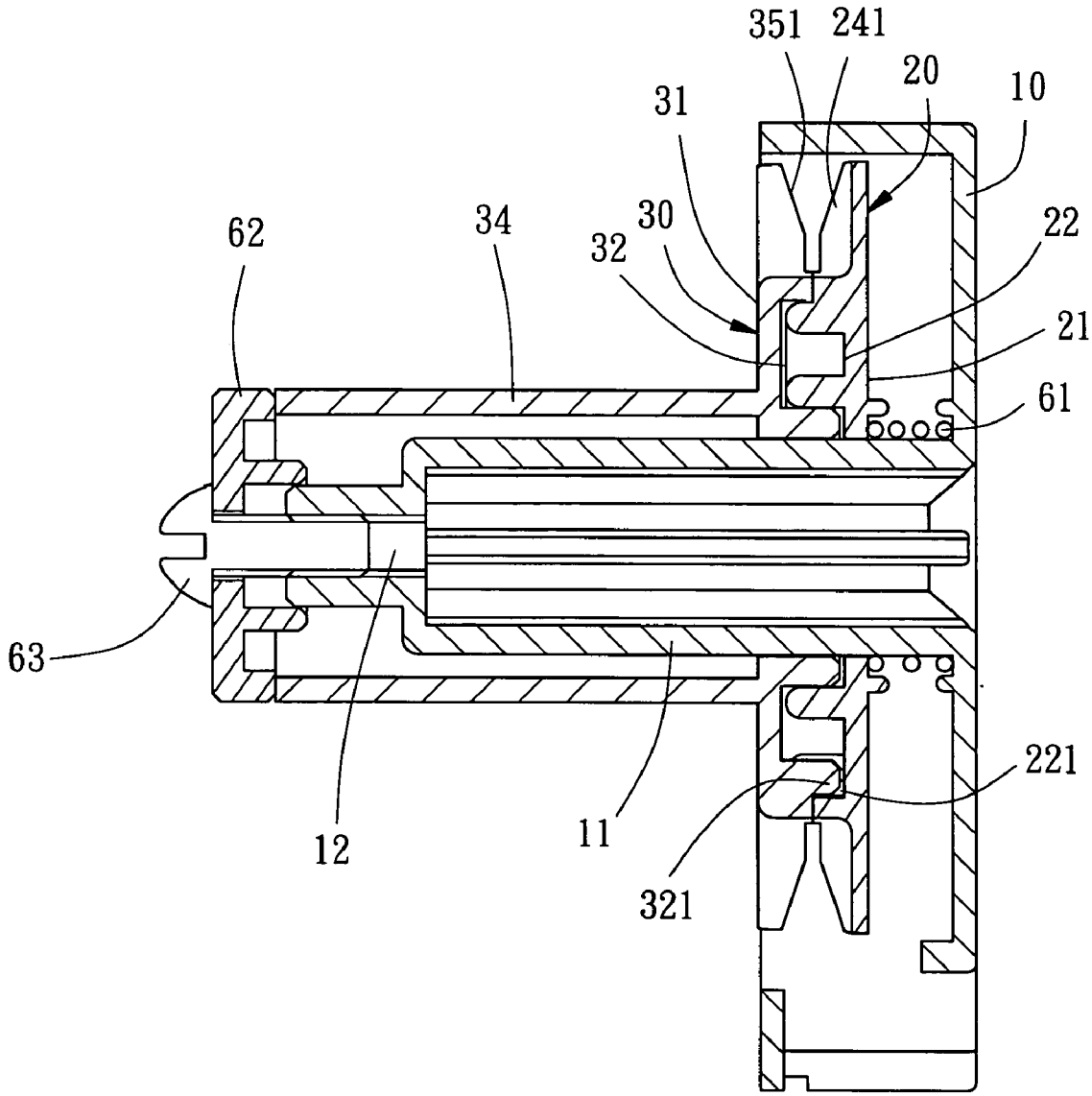
FIG. 7 is a sectional view taken along line 7—7 of FIG. 6.

FIGS. 5–7 show a cord-driven rotator 200 constructed according to the second preferred embodiment of the present invention. The cord-driven rotator 200 is comprised of a base 10, a first clamping plate 20, a second clamping plate 30, two positioning members 40, and an elastic biasing device 60.

The base 10 comprises a shaft 11, which has a screw hole 12 axially extended in the distal end.

The first clamping plate 20 is shaped like a circular member having a stop face 21, a clamping face 22 opposite to the top face 21, a center axle hole 23 cut through the stop face 21 and the clamping face 22 at the center and coupled to the shaft 11 of the base 10 to let the stop face 21 be set in close contact with the inside wall of the base 10, a coupling groove 221 formed in the clamping face 22, and a plurality of fins 24 equiangularly spaced around the periphery. The fins 24 each have a radially extended groove 241 corresponding to the clamping face 22, and two sloping edges 242 radially extended along two sides of the groove 241. The height of the sloping edges 242 gradually reduces in direction from the inner side toward the outer side.

The second clamping plate 30 is shaped like a circular member having a stop face 31, a clamping face 32 opposite to the stop face 31, a center axle hole 33 cut through the stop face 31 and the clamping face 32 at the center and coupled to the shaft 11 of the base 10 to let the clamping face 32 face be set in contact with the clamping face 22 of the first clamping plate 20, a coupling block 321 perpendicularly extended from the clamping face 32 and coupled to the coupling groove 221 of the first clamping plate 20 to let the second clamping plate 30 be synchronous rotatable with the first clamping plate 20 on the shaft 11 of the base 10, an axle sleeve 34 perpendicularly extended from the stop face 31 around the border of the center axle hole 33 and sleeved onto the shaft 11 of the base 10, and a plurality of fins 35 equiangularly spaced around the periphery. The fins 35 each have a radially extended groove 351 corresponding to the clamping face 32, and two sloping edges 352 radially extended along two sides of the groove 351. The height of the sloping edges 352 gradually reduces in direction from the inner side toward the outer side. The axle sleeve 34 has radial flanges 36 equiangularly spaced around the periphery for engaging into the roller of a window blind (not shown).

The two positioning members 40 are two tensile springs mounted inside the axle sleeve 34 and adapted to stop the first clamping plate 20 and the second clamping plate 30 from rotation and to further stop the blind shade or slats of the window blind in position after release of an external driving force from the clamping plates 20, 30.

The elastic biasing device 60 is comprised of a spring member 61, a washer 62, and a screw 63. The spring member 61 is sleeved onto the shaft 11 of the base 10, having one side stopped at the inside wall of the base 10 and the other side stopped at the stop face 21 of the first clamping plate 20. The washer 62 is stopped at the remote end of the axle sleeve 34 of the second clamping plate 30, having a center through hole 621. The screw 63 is inserted through the center through hole 621 of the washer 62 and threaded into the screw hole 12 of the shaft 11 of the base 10 to secure the washer 62 to the shaft 11. Therefore, the spring member 61 imparts a resilient contacting force to the first clamping plate 20 against the second clamping plate 30, and a clamping force is produced between the clamping face 22 of the first clamping plate 20 and the clamping face 32 of the second clamping plate 30 to retain the lift cord that is positioned in between the clamping face 22 of the first clamping plate 20 and the clamping face 32 of the second clamping plate 30. Therefore, the invention effectively prevents slipping of the lift cord. This embodiment can also be used with a lift chain of beads. When used with a lift chain of beads, the beads of the lift chain of beads can be positioned in the between the matched grooves 241, 351 or in the grooves 241, 351 that are arranged in a staggered manner, preventing slipping of the lift chain of beads. In addition to the aforesaid cord member clamping effect, the pitch between the clamping face 22 of the first clamping plate 20 and the clamping face 32 of the second clamping plate 30 can be elastically adjusted to fit different thickness of lift cords or lift chains of beads.

In the aforesaid two embodiments, an elastic biasing device is used to urge two separated clamping plates toward each other. In the aforesaid first embodiment, the elastic biasing device indirectly forces the second clamping plate against the first clamping plate. In the aforesaid second embodiment, the elastic biasing device directly forces the first clamping plate against the second clamping plate.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A cord-driven rotator for driving a roller of a window blind, said cord-driven rotator comprising:

a base having a shaft located at an exterior side of the rotator;

a first clamping plate and a second clamping plate rotatably serially mounted on said shaft for clamping a cord member therebetween;

an elastic biasing device provided between said base and said first and second clamping plates to impart an elastic force to urge the one of said first and second clamping plates against the other of said first and second clamping plates.

2. The cord-driven rotator as claimed in claim 1, wherein said first clamping plate comprises a stop face, a clamping face opposite to the stop face, a center axle hole for the passing of said shaft of said base, and a coupling groove in the clamping face; said second damping plate comprises a stop face, a clamping face opposite to the stop face of said second clamping plate and facing the clamping face of said first clamping plate, a center axle hole for the passing of said shaft of said base, and a coupling block coupled to the coupling groove of said first clamping plate for enabling said second damping plate to be synchronously rotated with said first clamping plate on said shaft of said base.

3. The cord-driven rotator as claimed in claim 2, wherein said second clamping plate further comprises an axle sleeve perpendicularly extended from the stop face thereof around the center axle hole of said second clamping plate and sleeved onto said shaft of said base, and two tensile springs sleeved onto said shaft of said base within said axle sleeve.

4. The cord-driven rotator as claimed in claim 3, further comprising a hub sleeved onto said axle sleeve for rotary motion with said second clamping plate; wherein said elastic biasing device comprises a spring member having one side stopped at said hub, a washer stopped at the other side of said spring member, said washer having a center through hole, and a screw inserted through said center trough hole of said washer and fastened to said shaft.

5. The cord-driven rotator as claimed in claim 2, wherein said first clamping plate further comprises a plurality of radial fins equiangularly spaced around a periphery thereof, the radial fins of said first clamping plate each having a radially extended groove; said second clamping plate further comprises a plurality of radial fins equiangularly spaced around a periphery thereof, the radial fins of said second clamping plate each having a radially extended groove.

6. The cord-driven rotator as claimed in claim 5, wherein the radial fins of said first clamping plate and said second clamping plate each have two sloping edges radially extended along two sides of the groove of the respective radial fin, said sloping edges having a height gradually reducing in direction from a center of the respective clamping plate toward a border area of the respective clamping plate.

7. The cord-driven rotator as claimed in claim 2, wherein said elastic biasing device comprises a washer stopped at said second clamping plate, said washer having a center through hole, a screw inserted through the center through hole of said washer and fastened to said shaft and a spring member sleeved onto said shaft and stopped between said base and said first clamping plate for urging said first clamping plate toward said second clamping plate.

8. The cord-driven rotator as claimed in claim 1, wherein said first clamping plate comprises a coupling groove and said second clamping plate comprises a coupling block engaged into the coupling groove such that said first and second clamping plates are rotatable synchronously.

9. The cord-driven rotator as claimed in claim 8, wherein said elastic biasing device comprises a spring member sleeved onto said shaft of said base and stopped between said base and said first clamping plate for urging said first clamping plate toward said second clamping plate.

* * * * *